US006746750B1

(12) United States Patent
Bishopp

(10) Patent No.: US 6,746,750 B1
(45) Date of Patent: Jun. 8, 2004

(54) ENVELOPE DEVICE CONTAINING A LIQUID VOLATILE MATERIAL AND METHOD FOR MAKING SUCH A DEVICE

(75) Inventor: Derek Albert Bishopp, Saint James (GB)

(73) Assignee: AKI, Inc., New York, NY (US)

( * ) Notice: Subject to any disclaimer, the term of this patent is extended or adjusted under 35 U.S.C. 154(b) by 0 days.

(21) Appl. No.: 09/530,859

(22) PCT Filed: Nov. 9, 1998

(86) PCT No.: PCT/GB98/03314

§ 371 (c)(1),
(2), (4) Date: Jun. 19, 2000

(87) PCT Pub. No.: WO99/23909

PCT Pub. Date: May 20, 1999

(30) Foreign Application Priority Data

Nov. 7, 1997 (GB) ..... 9723452

(51) Int. Cl.[7] ..... B32B 3/04; A24F 25/00; A61L 9/04

(52) U.S. Cl. ..... 428/128; 428/127; 428/126; 428/121; 428/36.6; 428/35.7; 428/36.7; 428/905; 428/41.5; 428/480; 239/34

(58) Field of Search ..... 428/40.1, 43, 126, 428/194, 905, 35.7, 36.6, 35.2, 41.3, 41.5, 121, 127, 128, 36.7, 480; 239/34

(56) References Cited

U.S. PATENT DOCUMENTS 5,248,537 A * 9/1993 Giannavola ..... 428/40
5,439,172 A * 8/1995 Comyn et al. ..... 239/34
5,882,789 A * 3/1999 Jones et al. ..... 428/349

* cited by examiner

*Primary Examiner*—Harold Pyon
*Assistant Examiner*—Michael C. Miggins
(74) *Attorney, Agent, or Firm*—Pennie & Edmonds LLP

(57) ABSTRACT

The present invention provides a generally planar closed envelope device formed from material having vapor barrier properties, which envelope comprises a base layer (1) and a cover layer (4) applied to the base layer (1) and a continuous or discontinuous seal (4) therebetween, characterized in that: a) each of the base (1) and cover (3) layers carries a fluid composition (2) containing a liquid volatile material upon a selected area of the opposed faces thereof; f) the base (1) and cover (3) layers are formed by folding over a single piece of sheet material so as to bring the selected areas of the base (1) and cover (3) layers into opposing register with one another; and g) there is separable and reformable seal (4) between the base (1) and cover (3) layers to retain them in the folded configuration. The invention also provides a method for making such a device.

8 Claims, 2 Drawing Sheets

ENVELOPE DEVICE CONTAINING A LIQUID VOLATILE MATERIAL AND METHOD FOR MAKING SUCH A DEVICE

The present invention relates to a device, notably to a device for sampling fragrances or other volatile materials.

BACKGROUND TO THE INVENTION

In our U.S. Pat. Nos. 5,341,992 and 5,439,172 we have described various forms of sampler for a fluid volatile material, for example a liquid fragrance oil in an alcohol or other fluid carrier or diluent. In a preferred embodiment, the sampler comprises a base layer, notably one made from a polymer, especially a polyester polymer, which is micro-permeable to an organic volatile fluid applied to it, whereby the base layer absorbs the fluid on a molecular scale and acts as a reservoir for the volatile fluid. A cover layer, preferably also of a polyester or similar polymer, is applied over at least that area of the base layer which carries the volatile fluid. The cover is secured in position by an adhesive, preferably in the form of an annulus around the area of the base layer which carries the volatile fluid. The base and cover layers form, with the adhesive seal therebetween, a substantially vapour proof envelope for the volatile material.

When the cover layer is peeled back or otherwise removed to expose that part of the base layer carrying the volatile fluid to the atmosphere, the volatile fluid can volatilise directly into the atmosphere or the surrounds of the device. The adhesive is preferably of a pressure sensitive type, for example a water based acrylic adhesive, so that the seal between the base and cover layers can be broken when the cover layer is peeled back, and yet the cover layer can be re-applied to the base layer to re-form the seal and prevent further release of the volatile material from the base layer.

Such devices provide a simple means by which a volatile material can be presented to a user in a substantially sealed sampler from which little or none of the volatile material escapes until required and which can then be re-sealed to prevent further escape once the user has sampled the volatile material within the device. However, we have found that with prolonged storage of such devices where the volatile liquid material is a fragrance oil or the like, the apparent strength of the fragrance perceived by a user when the cover layer is peeled back from the base layer is less than would have been expected. Attempts to apply a greater loading of the volatile fluid to the base layer, for example by increasing the nip gap of the printing roller used to apply the fluid composition containing the liquid volatile material as described in our U.S. Pat. No. 5,439,172, have not been wholly successful.

It was also proposed in our U.S. Pat. No. 5,439,172 to apply the fluid composition to the cover layer rather than the base layer. A possible method for reducing the perceived loss of fragrance might be to apply the fragrance oil to both the base and cover layers. However, this would then require that the fragrance coated base and cover layers be brought into exact register with one another so as avoid the fragrance printed areas of the two layers overlapping the adhesive applied to either or both layers. Due to the aggressive nature of fragrance oils, this would result in degradation of the adhesive and contamination of the rendition of the fragrance. Accurate registration of two moving webs of material is complex and requires strict control of the operation of the machinery for bringing the two webs into contact with one another. The control and accuracy required is often more than can be achieved on a commercial scale operation.

We have now devised a form of construction of the sampler which reduces these problems.

SUMMARY OF THE INVENTION

Accordingly, the present invention provides a generally planar closed envelope device formed from material having vapour barrier properties, which envelope comprises a base layer and a cover layer applied to the base layer and a continuous or discontinuous seal therebetween, characterised in that:

a. each of the base and cover layers carries a fluid composition containing a liquid volatile material upon a selected area of the opposed faces thereof;

b. the base and cover layers are formed by folding over a single piece of sheet material so as to bring the selected areas of the base and cover layers into opposing register with one another; and c. there is a separable and reformable seal between the base and cover layers to retain them in the folded configuration.

The invention also provides a method for making a device for selectively releasing a volatile material into its environment, which device comprises a substantially vapour tight envelope containing a volatile material which it is desired to release into that environment by opening of the envelope, which envelope comprises:

a. a base layer having vapour barrier properties, having applied directly to a selected area of a first face thereof a fluid material containing a liquid volatile material;

b. a cover layer having vapour barrier properties applied over said selected area of the said first face of the base layer; and c. a seal between at least the periphery of said base and cover layers so as to form with said base and cover layers a substantially vapour tight envelope for said liquid volatile material, said seal being separable whereby the cover layer can be removed at least partially from said base layer to expose at least part of the base layer so as to permit release of the volatile material, said seal also being re-formable upon replacement of said cover layer so as to prevent further release of said volatile material when the cover layer is replaced upon said base layer, characterised in that the method comprises:

i. applying the fluid material containing the liquid volatile material to two selected areas of a single sheet of the material of said base layer;

ii. severing the material carrying both such selected areas from said sheet as a single unit;

iv. prior to, during or subsequent to the severing of the unit from the sheet, folding the material carrying the two selected areas so as to bring the faces carrying the two selected areas into opposition with one another and thus form the base and cover layers of the envelope for the volatile material; and v. securing the folded material in the folded configuration so as to form the substantially vapour tight envelope.

Preferably, the base and cover layers are secured in the folded configuration by a continuous or discontinuous strip of an adhesive composition around at least part of the periphery of either or both the selected areas on the base and/or cover layers. Preferably also the base and cover layers are generally planar and are formed from a substantially vapour proof material.

Preferably, the base and cover layers are formed as substantially congruent circular pieces of material linked by a bridging piece about which the circular pieces can be folded so as to bring them into opposed register with each other and form the envelope device of the invention. Thus, in a preferred embodiment, the envelope device of the invention is formed by printing the liquid volatile material or a liquid, gel or slurry composition containing it onto the circular ends of a generally figure of eight shaped area of a substantially vapour proof sheet material. A strip of adhesive is then applied around at least part of the peripheries of either or both of the areas to which the volatile material has been applied. The sheet material is then folded at the neck of material linking the circular ends of the figure of eight, the bridging piece, to bring the circular ends into opposition to one another with the adhesive and the area(s) of the volatile material sandwiched between them and thus form a generally circular envelope containing the volatile material. The use of a single piece of sheet material to form both the base and cover layers of the device ensures accurate positioning of the selected areas and adhesive strips on the sheet of material and ensures accurate registration of these areas as the sheet of material is folded. The invention thus overcomes the difficulties imposed by the use of separate webs of sheet material to provide the base and cover layers separately.

For convenience,

- the term liquid volatile material will be used to identify the material which it is desired to release from the base and cover layers by volatilisation when the areas of those layers to which the liquid volatile material has be applied are exposed by separation of the base and cover layers; and
- the term fluid composition will be used herein to denote the fluid composition in which the volatile liquid is applied to the base and cover layers, and such fluid compositions may contain other, non-volatile, ingredients such as thickeners for the liquid volatile material and such non-volatile materials may remain upon the surface of the base and/or cover layer once the liquid volatile material has been released from the device.

The device of the invention is of essentially the same construction, operation and application as the device described in our U.S. Pat. No. 5,439,172, except for the provision of the base and cover layers from a single piece of sheet material rather than from two separate pieces of material. As a result, it is not necessary to bring two separate webs of material into register with one another. Such registration is inherently achieved when the two opposed ends of the single piece of material are folded together. It is thus possible to apply the volatile material to both the base and cover layers of the envelope using simple printing techniques which can apply the desired material to accurately positioned locations on a single web of material.

The invention can be applied to a wide range of liquid volatile materials, notably a natural or synthetic fragrance oil. However, the invention may also be applied to the formation of sealed envelopes for the release of other volatile materials, for example aromatic oils in aromatherapy, to release vapours of a medicament, to release vapours of a pesticide for use in a glasshouse, to release vapours of a rust inhibitor for use in a tool chest, to release scents of foodstuffs and so on. The volatile liquid is preferably a fine fragrance in the form of an oil or an alcohol solution of the essential fragrance oil.

For convenience, the invention will be described hereinafter in terms of such a preferred application.

The liquid volatile material may be applied as such to the base and cover layers. For example, it may consist essentially of a natural or synthetic fragrance oil diluted with ethanol. However, it may be desired to incorporate a viscosity modifying component into the fragrance oil/ethanol mixture to adjust the viscosity of the mixture so as to render it suitable for application to the sheet material which is to form the base and cover layers using a printing technique as described below. Suitable viscosity modifying agents include fumed silica, cellulosic derivatives such as cellulose nitrate, hydrocarbon resins such as styrene polymers or copolymers, polyvinylpyrrolidone, or acrylic or vinylic polymers as are conventionally used as thickeners in the pharmaceutical or cosmetic industries. If desired, the surface adhesive properties of such polymers may be modified to reduce adhesion of the fluid composition containing them to the cover layer making it difficult to peel the cover layer from the base layer. For example, a polyvinyl alcohol type of thickening agent can be modified by inserting long chain, for example stearic and/or oleic, groups as side branches to the main polyvinyl backbone molecule of the polyvinyl alcohol.

It is preferred that the base and cover layers be made from a polymer which is micro-permeable to the liquid volatile material so that the volatile liquid is absorbed on a molecular scale within the polymer matrix, which then acts as a reservoir for the volatile material. Suitable polymers include polyesters or a laminated or composite material which has a polyester face or layer to which the volatile material is applied. In some cases it may be desirable to provide a layer of a metal foil or of a polyvinylidene dichloride polymer on the other faces of the base and cover layer to further minimise loss of volatile material from the device.

The face of the material of the base and cover layers to which the fluid material is to be applied may have been subjected to a pre-treatment, for example a corona discharge treatment or pre-coating with a polyacrylate polymer as known in the art, to enhance the wetting of the surface of the layer by the fluid material applied thereto. This assists the migration of the volatile liquid into the polymer matrix of the layer.

Such a sampler is preferably made by applying the fluid composition containing the fragrance to the sheet from which the base and cover layers are to be formed using a roller applicator, for example a flexographic or an offset lithographic printer, as if the fragrance were a printers ink. The roller preferably prints two adjacent circles of fragrance on the polymer sheet and this can be achieved using a single sculptured roller so that the two circles are accurately positioned with respect to each other.

The base and cover layers can be secured wholly or in part in the folded configuration using the autoadhesive properties of the polymer from which they are formed. However, it is preferred to provide the adhesive action by means of continuous or discontinuous strip of a pressure sensitive adhesive which extends around at least part or all of the periphery of either or both of the areas to which the fluid composition has been applied. The adhesive is preferably a pressure sensitive adhesive so that the adhesive seal between the base and cover layers can be made and unmade a number of times to permit repeated use of the device. Suitable adhesives for present use include, for example, water based polyacrylic acid or polyacrylate adhesives.

The strip of adhesive can be applied to one or both of the base and cover layers and can extend circumferentially fully around the area to which the fluid composition has been applied. Typically the strip(s) of adhesive will be located from 1 to 5 mms radially outwardly of the edge of the area to which the fluid composition has been applied. Alternatively, the adhesive strip may be discontinuous, where the discontinuities are not so great as to permit excessive escape of the volatile material and/or where the autoadhesive properties of the material from which the base and cover layers is made are sufficient to provide an adequate seal. For convenience, the invention will be described hereinafter in terms of a continuous strip of a pressure sensitive adhesive formed around substantially the whole of the periphery of each area to which the fluid composition has been applied to the base and/or cover layers.

The adhesive strip(s) can be applied by a suitably sculptured roller applicator whose operation can be accurately interlinked with the application of the fluid composition using conventional indexing techniques as used in the printing industry, since both materials are being applied to the same single sheet of material.

A particularly preferred method for making the sheet material carrying the fluid composition and the adhesive strip(s) is that described in our U.S. Pat. No. 5,439,172, notably that defined in claim 10 thereof.

The device of the invention may be provided with other features which enhance its utility. Thus, for example a layer of adhesive can be applied to the face of the base layer to which the fluid material has not been applied so that the device can be attached to a user's clothing or other surface. This adhesive layer can be a pressure sensitive adhesive of the type used to form the adhesive strip(s) between the base and cover layers of the device. The adhesive layer may be protected by a removable layer, for example a siliconised paper sheet, which is removed prior to use.

The sheet of material carrying the fluid composition containing the liquid volatile material and associated adhesive strip(s) is cut to form the base and cover layers connected together by severing the required area of material from the sheet of which it forms part. This can be done using any suitable technique, for example a laser cutter, air or water blade. However, it is preferred to sever the material from the sheet using a roller cutter whose operation can be accurately interlinked with that of the previous operations for applying the fluid composition and the adhesive, so that the required figure of eight or other shape of material can be cut accurately in register with the areas carrying the two circles of volatile material and the adhesive strip(s).

The sheet material carrying the fluid material and the adhesive must also be folded to bring the areas carrying the volatile material and adhesive into opposition with one another, the folded configuration. This can be done subsequent to severing the material of the base and cover layers from the sheet, in which case the severed portion of material is folded about the centre line of the piece bridging the areas carrying the volatile material using conventional folding techniques and equipment to form the closed envelope device of the invention directly. This can be passed through the nip of a pair of rollers to ensure a good seal between the base and cover layers, or this can occur as part of the folding process. Where the folding is carried out before the severing of the individual portions from the sheet, the sheet is folded transversely across the bridging pieces of a number of areas to which the volatile material has been applied in parallel across the width of the sheet, for example using a conventional concertina folder. The individual pieces can then be cut from the folded sheet to form the individual devices of the invention.

The folded sheet or the individual devices can be subjected to any desired post treatment, for example printing of images on the exposed surfaces of the base and/or cover layers, the application of a continuous or discontinuous layer or coating of adhesive to the exposed face of the base layer, where this is not already present, so that the device can be secured to a printed page or other substrate by the adhesive. If desired, an annular heat seal can be formed radially inwardly or outwardly of the adhesive seal to enhance the integrity of the device for transport and storage. The optimal position for the heat seal will depend upon a number of factors, for example the expected storage period and the forms of plastic which are used to make the base and cover layers. In general, unless strength considerations prevent it, it is preferred to form the heat seal immediately radially adjacent, i.e. contiguous with or within 2 mms radially, of the adhesive seal. If desired, the heat seal can be located within the radial extent of the adhesive seal, for example where heat aids curing of the adhesive seal. Furthermore, the heat seal need not be continuous but could be formed intermittently or with areas of weakness within the seal so that the heat seal can more readily be separated. We have also found that the pressure required to form the heat seal may assist formation of a good bond between the adhesive and the base and cover layers.

In use, a user separates the cover layer from the base layer by separating the adhesive seal between the base and cover layers. If desired, a portion of the cover layer which is not adhered to the base layer can provide a pull tab by which the user can peel back the cover layer. Having exposed the area of the base layer to which the fluid material has been applied, the user can then either sniff the fragrance released from the exposed base layer, or can wipe the exposed surface of the base layer against his or her skin so as to transfer some of the fluid material to his or her skin. Alternatively, the user can secure the opened device to an area of his or her clothing using the adhesive layer applied to the other face of the base layer.

Once the user has sampled the fragrance to his or her satisfaction, the cover layer can be replaced upon the base layer and is secured in position by the adhesive strip(s) to reform a sealed envelope. This prevents further release of the volatile material until the cover layer is removed again. We have found that the bridging piece between the base and cover layers not only retains the cover layer integral with the device, thus preventing its loss, but also acts to assist accurate registration of the cover layer upon the base layer during resealing of the device

DESCRIPTION OF THE DRAWINGS

A preferred form of the device of the invention will now be described by way of illustration with respect to the accompanying drawings in which.

DESCRIPTION OF THE PREFERRED EMBODIMENT

Figure 1:
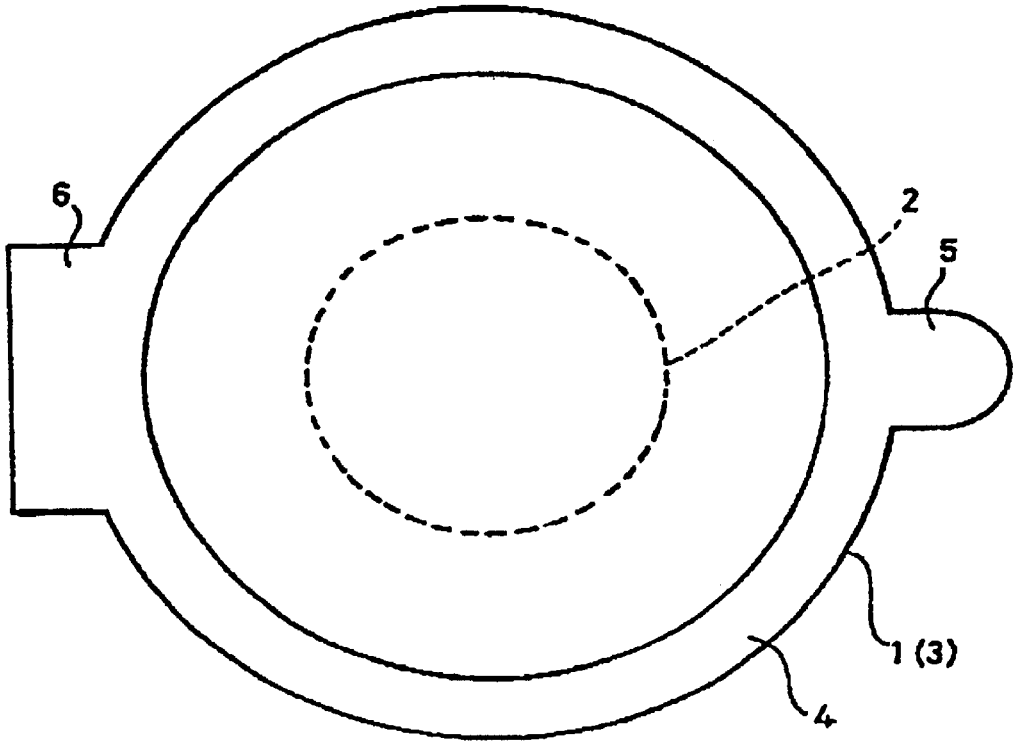
FIG. 1 is a plan view of the device from above.

The device comprises a 20 micrometer thick base layer 1 of a polyester polymer, such as that sold under the Registered Trade Mark MYLAR. A coating 2 of a fragrance oil/ethanol mixture is applied by a conventional roller printer to the central area of the base layer. A cover layer 3 of the same MYLAR material as the base layer 1 is secured to the base layer by an annular ring 4 of a pressure sensitive water based acrylic adhesive. The cover layer 3 and/or the base layer 1 has a radially extending pull tab 5 whereby the cover layer can be peeled back from the base layer 1 to expose the fragrance coated area 2 of the base layer to release the volatile fragrance. The base and cover layers are connected together by a folded over bridging piece 6.

Figure 3:
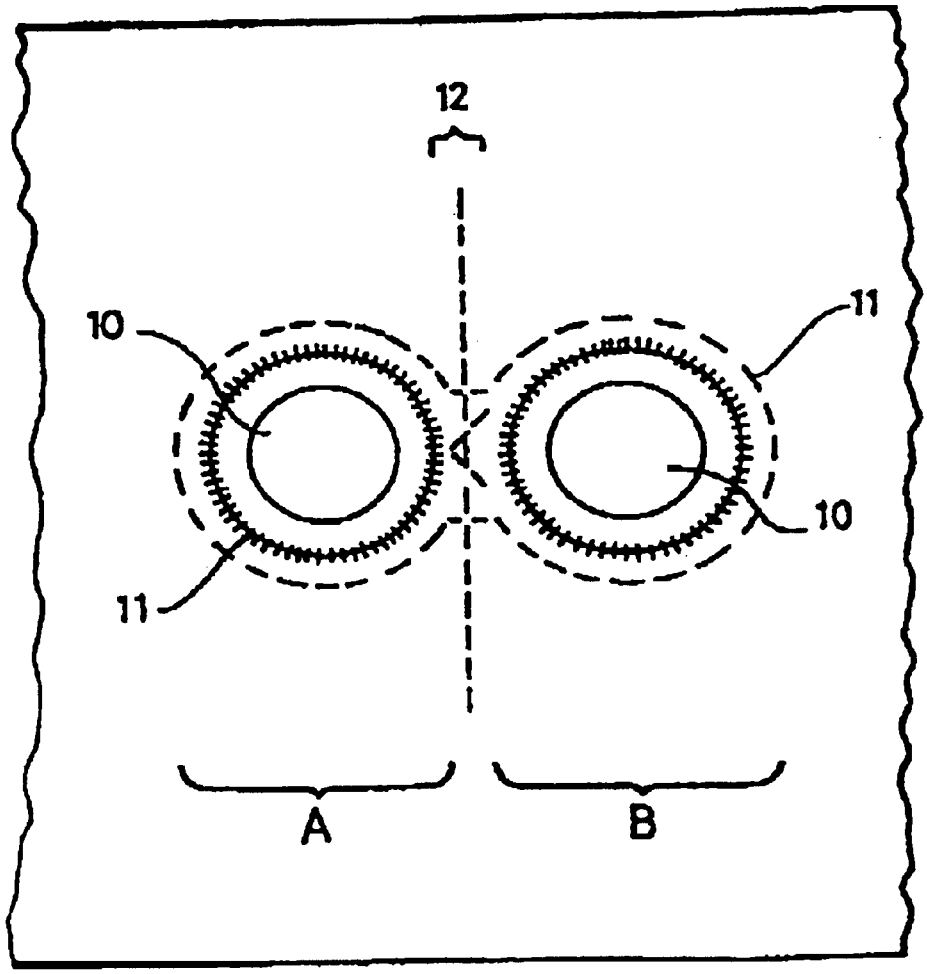
FIG. 3 is a plan view of a sheet of material carrying the fluid composition containing the volatile liquid and the strip(s) of adhesive prior to severing and folding of the material to form the device of FIG. 1.

Such a device can be prepared by the technique described in relation to FIGS. 3 and 4 of our U.S. Pat. No. 5,439,172 by applying the fluid composition containing the liquid volatile material, and the adhesive to a single sheet of the polyester using the roller printing technique described in our U.S. patent. This permits the use of a single sculptured roller to apply both circles 10 of the fluid composition to accurately specified positions upon the sheet.

The adhesive strip(s) 11 can be applied by a second sculptured roller applicator whose operation can be directly mechanically or otherwise linked to the operation of the first sculptured roller so that the adhesive strip(s) can be applied accurately in the desired register to the circles 10 of the fluid composition. As shown in FIG. 3, the fluid composition can be applied as pairs of circles 10 and the adhesive can also be applied as radially larger circles or as the figure of eight configuration shown dotted. However, other patterns of deposition of the pairs of areas for the fluid composition and the adhesive may be used if desired.

Typically, the roller or other applicators will apply the fluid composition to the areas A and B shown in FIG. 3 of the sheet material which are to form the fluid carrying areas of the base and cover layers of the device of FIG. 1 at such a loading as will give about 10 to 100 micrograms of fragrance oil or other volatile material per square meter of sheet material. This loading need not be the same for each of areas A and B, but the area B could carry less volatile material, for example by being smaller or by being applied by a separate roller applicator operating at a smaller nip gap, which will deposit a thinner layer or coating of the fluid composition. Thus, the area A could carry 60% of the total fluid composition applied to both areas A and B, and area B only 40% or vice versa.

Figure 2:
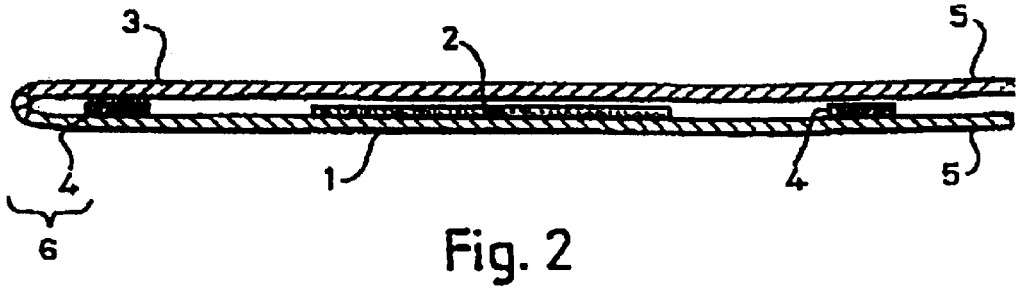
FIG. 2 is a vertical section through the device of FIG. 1 along the diameter of the device.

The areas of the sheet material which are to provide the base and cover layers are outlined in FIG. 3 and are linked by the neck of material, the bridging piece 12, between them. These areas are cut from the sheet of material by any suitable technique, for example by a rotary cutter whose operation is mechanically or otherwise interlinked with the operation of the roller applicators of the fluid composition and the adhesive. The severed portions are then folded about the bridging piece 12, for example about the transverse centre line of the bridging piece, shown dotted in FIG. 3, to bring the faces carrying areas A and B into opposition to one another and the adhesive into contact with the opposed face of the sheet to form the folded device shown in FIG. 2. If desired, this folded device can be passed through the nip of a pair of rollers to form a secure adhesive bond between the opposed faces. Where a laser or other hot cutting technique is used to sever the sheet material, this may cause partial or complete fusion of the cut edges of opposes faces of the device, notably where the folding of the material is carried out prior to severing the device from the sheet of material. Such fusion may form a secondary heat seal 13 radially outward figure of the adhesive bond between the base and cover layers.

What is claimed is:

1. A substantially planar closed envelope device comprising a material having vapor barrier properties, which envelope comprises a base layer and a cover layer applied to the base layer and a continuous or discontinuous seal therebetween, wherein:

a. each of the base and cover layers has an opposed face and carries a fluid composition containing a liquid volatile material upon a selected area of the opposed faces thereof;

b. the base and cover layers are formed from a single piece of sheet material that is folded over so as to bring the selected areas of the base and cover layers into opposing register with one another; and c. the seal comprises a separable and reformable seal between the base and cover layers to retain the base layer and cover layer in the folded configuration; and wherein the base and cover layers are formed from a sheet material that comprises substantially congruent pieces of material linked by a bridging piece about which the circular pieces are folded so as to bring them into opposed register with each other.

2. A device as claimed in claim 1, wherein:

a. the liquid volatile material is applied to selected areas of the circular pieces of the sheet material;

b. the seal comprises a strip of adhesive composition that is applied around at least part of the peripheries of either or both of the selected areas; and c. the sheet material comprises a substantially vapour proof sheet material.

3. A device as claimed in claim 1, wherein the seal comprises a continuous or discontinuous strip of an adhesive composition disposed around at least part of the periphery of either or both the selected areas.

4. A device as claimed in claim 3, wherein the liquid volatile material and the adhesive composition are applied to the sheet material using a roller application technique.

5. A device as claimed in claim 1, wherein the sheet material is made from a material having at least a surface layer made from a polymer which is micropermeable to the liquid volatile material.

6. A device as claimed in claim 5, wherein the sheet material is a polyester polymer.

7. A device as claimed in claim 1, wherein the seal also includes a heat seal.

8. A device as claimed in claim 7, wherein the heat seal is located radially outward of the adhesive seal.

* * * * *